US006186026B1

(12) United States Patent
Shaw et al.

(10) Patent No.: US 6,186,026 B1
(45) Date of Patent: Feb. 13, 2001

(54) BRAKE PEDAL FOR MOTOR VEHICLE

(75) Inventors: Schuyler Scott Shaw; Bryan Peter Riddiford, both of Dayton; Donald Edward Schenk, Vandalla, all of OH (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/283,433

(22) Filed: Apr. 1, 1999

(51) Int. Cl.[7] ..... G05G 1/14
(52) U.S. Cl. ..... 74/512; 74/560; 123/399
(58) Field of Search ..... 74/512–514, 560; 123/399

(56) References Cited

U.S. PATENT DOCUMENTS

| | | | | |
|---|---|---|---|---|
| 4,958,607 | * | 9/1990 | Lundberg | 123/399 |
| 5,233,882 | * | 8/1993 | Byram et al. | 123/399 |
| 5,385,068 | * | 1/1995 | White et al. | 74/512 |
| 5,415,144 | * | 5/1995 | Hardin et al. | 123/399 |
| 5,729,979 | | 3/1998 | Shaw et al. | 60/533 |
| 5,868,040 | * | 2/1999 | Papenhagen et al. | 74/513 |
| 5,887,488 | * | 3/1999 | Riggle | 123/399 X |
| 5,937,707 | * | 8/1999 | Rixon et al. | 74/560 |
| 6,003,492 | * | 12/1999 | Muto et al. | 123/399 |
| 6,019,016 | * | 2/2000 | Takagi et al. | 123/399 X |

FOREIGN PATENT DOCUMENTS

| | | | | |
|---|---|---|---|---|
| 1164637 | * | 2/1980 | (FR) | 74/512 |
| 2833792 A1 | * | 2/1980 | (DE) | 123/399 |

* cited by examiner

*Primary Examiner*—Vinh T. Luong
(74) *Attorney, Agent, or Firm*—Robert M. Sigler

(57) ABSTRACT

A brake pedal for a motor vehicle brake-by-wire brake system including a pedal lever resiliently flexible in beam bending, a foot pad on the pedal lever, and a mounting for the pedal lever on a body of the motor vehicle which constitutes the pedal lever a variable stiffness cantilever spring. The mounting for the pedal lever includes a socket for an inboard end of the pedal lever, a stationary reaction surface on the body of the motor vehicle, and a pedal lever reaction surface on the pedal lever which faces and diverges from the stationary reaction surface in a release position of the pedal lever. The stationary reaction surface and the pedal lever reaction surface become progressively engaged concurrent with resilient flexure of the pedal lever in cantilever spring bending to vary the stiffness of the cantilever spring. The stationary and pedal lever reaction surfaces are contoured or "tuned" to yield a pedal force which initially increases slowly relative to pedal travel and then increases exponentially relative to pedal travel thereby emulating the relationship between pedal force and pedal travel of a brake pedal in a traditional motor vehicle brake system.

4 Claims, 1 Drawing Sheet

BRAKE PEDAL FOR MOTOR VEHICLE

TECHNICAL FIELD

This invention relates to a motor vehicle brake pedal.

BACKGROUND OF THE INVENTION

A traditional motor vehicle brake system includes a plurality of hydraulically actuated wheel brakes, a master cylinder, and a brake pedal. The brake pedal includes a pedal lever on a body of the motor vehicle linked to a piston assembly in the master cylinder. To apply the wheel brakes, an operator pushes on a foot pad on the pedal lever to pivot the pedal lever and linearly stroke the piston assembly in the master cylinder. The linear stroke of the piston assembly is opposed or resisted by a force attributable to fluid pressure in the wheel brakes and in a plurality of hydraulic channels between the wheel brakes and the master cylinder. The "pedal force" with which the operator must push on the foot pad to apply the wheel brakes mirrors the fluid pressure force opposing the stroke of the master cylinder piston assembly and initially increases slowly relative to pivotal movement of the pedal lever, i.e. relative to "pedal travel", as compliance in the wheel brakes and in the hydraulic channels is taken up. Then, pedal force increases at an increasing rate, i.e. exponentially, relative to pedal travel as the wheel brakes become applied. Motor vehicle operators perceive this relationship between pedal travel and pedal force as the "feel" of the brake system and, because of the widespread use of such traditional brake systems for many years, expect generally the same feel from all motor vehicle brake systems. Accordingly, in a motor vehicle brake system in which fluid pressure to apply a wheel brake is created independently of a brake master cylinder by an electro-hydraulic apparatus such as a pump and an electric motor, i.e. in a "brake-by-wire" brake system, the brake pedal is adapted to artificially mimic or emulate the feel of the brake pedal in a traditional brake system. For example, brake pedals described in U.S. Pat. Nos. 5,729,979 and 5,603,217, issued Mar. 24, 1998 and Feb. 18, 1997, respectively, and assigned to the assignee of the this invention, include elastomeric compliant elements which, when squeezed, mimic the fluid pressure force which opposes pedal travel in a traditional motor vehicle brake system. A brake pedal according to this invention is a novel alternative to prior brake pedals which emulate, in a brake-by-wire brake system, the fluid pressure force which opposes pedal travel in a traditional motor vehicle brake system.

SUMMARY OF THE INVENTION

This invention is a new and improved brake pedal for a motor vehicle brake-by-wire brake system including a pedal lever resiliently flexible in beam bending, a foot pad on the pedal lever, and a mounting for the pedal lever on a body of the motor vehicle which constitutes the pedal lever a variable stiffness cantilever spring. The mounting for the pedal lever includes a socket for an inboard end of the pedal lever, a stationary reaction surface on the body of the motor vehicle, and a pedal lever reaction surface on the pedal lever which faces and diverges from the stationary reaction surface in a release position of the pedal lever. The stationary reaction surface and the pedal lever reaction surface become progressively engaged concurrent with resilient flexure of the pedal lever in cantilever spring bending to vary the stiffness of the cantilever spring. The stationary and pedal lever reaction surfaces are contoured or "tuned" to yield a pedal force which initially increases slowly relative to pedal travel and then increases exponentially relative to pedal travel thereby emulating the relationship between pedal force and pedal travel of a brake pedal in a traditional motor vehicle brake system.

DESCRIPTION OF THE PREFERRED EMBODIMENT

Figure 1:
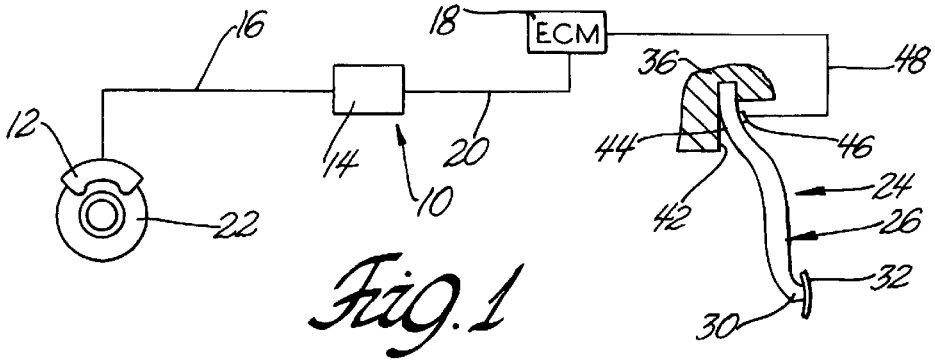
FIG. 1 is a fragmentary schematic representation of a motor vehicle brake-by-wire brake system including a brake pedal according to this invention.

Referring to FIG. 1, a schematically represented motor vehicle brake-by-wire brake system 10 includes a fluid pressure actuated wheel brake 12 connected to an electro-hydraulic fluid pressure apparatus 14, e.g. a pump driven by an electric motor, through a hydraulic channel 16. The fluid pressure apparatus 14 is controlled by an electronic control module ("ECM") 18 on the motor vehicle through a conductor 20 to selectively increase a fluid pressure in the hydraulic channel 16 and in the wheel brake 12 to apply the wheel brake to a brake rotor 22 on a wheel, not shown, of the motor vehicle and to release the rotor from the wheel brake by exhausting the fluid pressure in the hydraulic channel and in the wheel brake.

Figure 2:
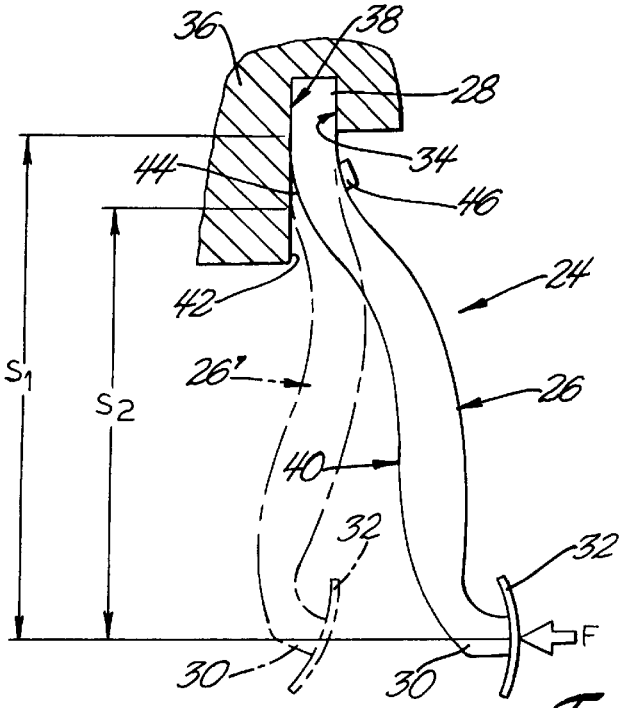
FIG. 2 is a schematic elevational view of the brake pedal according to this invention.

As seen best in FIG. 2, a brake pedal 24 according this invention for the brake-by-wire brake system 10 includes a pedal lever 26 having an inboard end 28 and an outboard end 30. The pedal lever 26 is a beam which may have any coimon structural shape in cross section, e.g. channel shaped, H-shaped, L-shaped, etc., and is preferably made from a composite material such as fiber reinforced plastic which renders the pedal lever resiliently flexible in beam bending. A foot pad 32 is attached to the pedal lever 26 at the outboard end 30 thereof.

The inboard end 28 of the pedal lever 26 is seated in a socket 34 in a fragmentarily illustrated structural portion 36 of a body 36, not shown, of the motor vehicle to constitute the brake pedal lever a cantilever spring on the body of the motor vehicle. A side 38 of the socket 34 facing a side 40 of the pedal lever opposite the foot pad 32 is extended beyond the socket and defines a stationary reaction surface 42 on the body of the motor vehicle. The fraction of the side 40 of the pedal lever facing the stationary reaction surface 42 defines a pedal lever reaction surface 44 on the pedal lever between the inboard end 28 thereof and the foot pad 32. Outboard of the socket 34, the pedal lever reaction surface 44 and the stationary reaction surface 42 diverge when the pedal lever is in a release position illustrated in solid lines in FIG. 2 characterized by the absence of flexure of the pedal lever in cantilever spring bending. A schematically represented transducer 46, e.g. a strain gage, Hall effect sensor, fiber optic device, or the like, on the pedal lever 26 is electronically linked to the ECM 18 through a conductor 48.

In operation, the pedal lever 26 assumes its release position when the foot of an operator of the motor vehicle is removed from the foot pad 32. A corresponding the electronic signal from the transducer 46 to the ECM 18 characteristic of instantaneous pedal force and pedal travel or the absence thereof causes the ECM to control the fluid pressure apparatus 14 to exhaust the fluid pressure in the hydraulic channel 16 and in the wheel brake 12 to release the brake rotor 22 from the wheel brake.

To stop or slow the motor vehicle, the operator pushes on the brake pedal 24 by applying a pedal force, schematically represented by a vector force "F", on the foot pad 32. The pedal lever 26 resiliently flexes clockwise, FIG. 2, in cantilever spring bending in response to application of the pedal force F thereby to mimic the pivotal movement of the pedal lever of a brake pedal in a traditional motor vehicle brake system. At the same time, an electronic signal from the transducer 46 on the pedal lever proportional to the input of the operator with respect to pedal travel and applied force causes the ECM 18 actuate the fluid pressure apparatus 14 to increase the fluid pressure in the hydraulic channel 16 and in the wheel brake 12 to squeeze the wheel brake against the brake rotor 22.

In its release position, the pedal lever 26 has an effective span $S_1$ between the socket 34 and the middle of the foot pad 32. As the pedal lever resiliently flexes clockwise in cantilever spring bending to a full brake apply position 26', FIG. 2, its effective span progressively decreases to an effective span $S_2$ as the pedal lever reaction surface 44 progressively engages the stationary reaction surface 42. As its effective span decreases, the stiffness of the cantilever spring defined by the pedal lever increases. Therefore, in order to stroke the pedal lever from its release position to its full brake apply position, the pedal force F applied by the operator on the foot pad 32 must vary at the rate the stiffness of the cantilever spring varies as dictated by the relative contours of the stationary reaction surface 42 and the pedal lever reaction surface 44.

Figure 3:
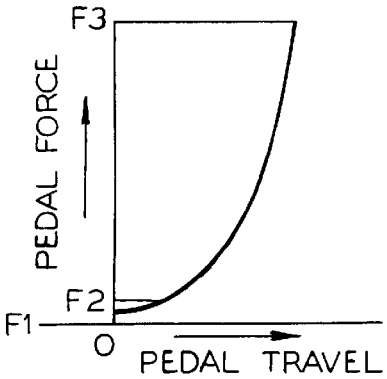
FIG. 3 is a graphic representation of the relationship between pedal force and pedal travel for the brake pedal according to this invention.

The stationary reaction surface 42, the pedal lever reaction surface 44, and the structural shape of the pedal lever 26 are all contoured to yield a relationship between pedal force and pedal travel which mimics or emulates the corresponding relationship in a traditional motor vehicle brake system. More particularly, the pedal lever 26 is stiff enough to remain substantially stationary until the pedal force F attains a small minimum magnitude $F_1$, FIG. 3, when the operator pushes on the foot pad 32. Then, the relative contours of the pedal lever reaction surface and the stationary reaction surface cause the pedal force F to increase slowly relative to pedal travel to an intermediate magnitude $F_2$ as the pedal lever flexes resiliently in cantilever spring bending to emulate the interval in the traditional motor vehicle brake system when compliance is eliminated from the hydraulic channels and the wheel brakes. Thereafter, the relative contours of the pedal lever reaction surface and the stationary reaction surface cause the pedal force F to increase at an increasing rate, i.e. exponentially, relative to pedal travel up to a maximum magnitude $F_3$ in the full apply position 26' of the pedal lever to emulate the interval in the traditional motor vehicle brake system during which the wheel brakes become applied.

When the operator releases the foot pad 32, the cantilever spring defined by the pedal lever 26 resiliently unbends to the release position of the pedal lever. At the same time, the transducer 46 electronically signals the ECM 18 to control the electro-hydraulic apparatus 14 to exhaust the fluid pressure in the hydraulic channel 16 and in the wheel brake 12 to release the brake rotor 22 from the wheel brake.

What is claimed is:

1. A motor vehicle brake pedal for a brake-by-wire brake system comprising:

a pedal lever resiliently flexible in beam bending having an inboard end and an outboard end, a socket means operative to rigidly connect the pedal lever at the inboard end thereof to a body of the motor vehicle thereby to constitute the pedal lever a cantilever spring on the body of the motor vehicle, a foot pad on the pedal lever at the outboard end thereof whereat a pedal force is applied to effect pedal travel in the form of resilient flexure of the pedal lever in cantilever spring bending from a release position to a brake full apply position, a stationary reaction surface on the vehicle body, and a pedal lever reaction surface on the pedal lever between the inboard end thereof and the foot pad diverging from the stationary reaction surface in the release position of the pedal lever and progressively engaging the stationary reaction surface in response to resilient flexure of the pedal lever in cantilever spring bending from the release position thereof to the brake full apply position thereof, the stationary reaction surface and pedal lever reaction surface being contoured relative to each other to vary the stiffness of the cantilever spring defined by the pedal lever in response to resilient flexure thereof in cantilever spring bending from the release position to the brake full apply position thereby to vary the rate of change of the pedal force relative to the pedal travel of the pedal lever.

2. The motor vehicle brake pedal for a brake-by-wire brake system recited in claim 1 wherein:

the stationary reaction surface and the pedal lever reaction surface are contoured relative to each other to yield a first interval in which the pedal force increases at a first rate relative to the pedal travel followed by a second interval in which the pedal force increases at a second rate relative to the pedal travel exceeding the first rate of increase relative to the pedal travel.

3. The motor vehicle brake pedal for a brake-by-wire brake system recited in claim 2 further comprising:

a transducer means on the pedal lever operative to provide an electronic signal corresponding to the position of the pedal lever between the release position thereof and the full brake apply position thereof and to the magnitude of the pedal force thereon.

4. The motor vehicle brake pedal for a brake-by-wire brake system recited in claim 3 wherein the transducer means comprises:

a device on the pedal lever selected from the group consisting of a strain gage and a Hall Effect sensor and a fiber optic device.

* * * * *